US006494761B1

(12) United States Patent
Amaral

(10) Patent No.: US 6,494,761 B1
(45) Date of Patent: Dec. 17, 2002

(54) YO-YO AND METHOD FOR ITS MANUFACTURE

(75) Inventor: Leonard R. Amaral, Rehoboth, MA (US)

(73) Assignee: Yomega Corporation, Fall River, MA (US)

( * ) Notice: Subject to any disclaimer, the term of this patent is extended or adjusted under 35 U.S.C. 154(b) by 453 days.

(21) Appl. No.: 09/035,047

(22) Filed: Mar. 5, 1998

Related U.S. Application Data

(60) Provisional application No. 60/061,493, filed on Oct. 9, 1997.

(51) Int. Cl.[7] ..... A63H 1/30
(52) U.S. Cl. ..... 446/247; 446/236; 446/250
(58) Field of Search ..... 441/236, 250, 441/251, 252, 248, 255, 256, 259, 260, 261; 403/21, 22

(56) References Cited

U.S. PATENT DOCUMENTS

| | | | | |
|---|---|---|---|---|
| 1,806,485 A | | 5/1931 | Mirafuentes | |
| 2,629,202 A | | 2/1953 | Stivers et al. | |
| 3,184,885 A | | 5/1965 | Gibson | |
| 3,201,895 A | | 8/1965 | Stivers | |
| 3,717,949 A | | 2/1973 | Radovan | |
| 3,953,936 A | | 5/1976 | Ennis | |
| 4,130,962 A | | 12/1978 | Ennis | |
| 4,207,701 A | * | 6/1980 | Kuhn | 446/250 |
| 4,327,518 A | | 5/1982 | Knauff | |
| 4,895,547 A | * | 1/1990 | Amaral | 446/250 |
| 5,017,172 A | * | 5/1991 | Seifert | 446/250 |
| 5,100,361 A | * | 3/1992 | Kuhn et al. | 446/250 |
| 5,813,898 A | | 9/1998 | Van Dan Elzen et al. | |

FOREIGN PATENT DOCUMENTS

DE 29712814 U1 9/1997

* cited by examiner

*Primary Examiner*—Derris H. Banks
*Assistant Examiner*—Dmitry Suhol
(74) *Attorney, Agent, or Firm*—Kirkpatrick Lockhart LLP

(57) ABSTRACT

Molded plastic yo-yo halves are connectible to each other by an axial having threaded ends that are adapted to threadably engage threaded inserts press fitted into a specially designed socket. The inserts are polygonal as are the sockets with the insertion end of the socket being provided with a shallow registration socket adapted to orient the threaded insert with respect to the socket. The yo-yo halves are molded separately and the inserts are press fitted into the sockets into a subsequent operation, resulting in manufacturing efficiencies as well as a strong properly aligned yo-yo construction.

24 Claims, 3 Drawing Sheets

YO-YO AND METHOD FOR ITS MANUFACTURE

CROSS-REFERENCE TO EARLIER APPLICATIONS

This application claims priority of U.S. provisional patent application No. 60/061,493, filed Oct. 9, 1997 and entitled "YO-YO AND METHOD FOR ITS MANUFACTURE".

FIELD OF THE INVENTION

This invention relates to improvements in yo-yos and methods for their manufacture.

BACKGROUND OF THE INVENTION

This invention relates to yo-yos, including, but not limited to high performance yo-yos as described in my U.S. Pat. No. 4,895,547 entitled Superior Performance Yo-Yo. Such high performance yo-yos are adapted to spin or "sleep" for extended periods of time, to permit lengthy and extended tricks to be performed before the yo-yo is wound up on its string.

Although the yo-yo construction described in my '547 patent achieves its intended objects, it would be desirable to make further improvements in its construction as well as to achieve further assembly and manufacturing efficiencies. The yo-yo is formed from a pair of injection molded plastic yo-yo halves in a conventional insert molding process in which a HeliCoil internally threaded insert, to which the yo-yo axle will attach, is placed in the mold. The mold then is closed and the plastic is injected into the mold to form the yo-yo half with the threaded insert embedded within the yo-yo half. Such conventional insert molding techniques include the use of core pins within the mold on which the inserts can be placed so that they will be located properly and in registry within the mold during the injection process. The inserts are selected from materials that are softer than those of the mold to avoid the possibility of the mold becoming damaged should an insert be improperly loaded or misaligned and the mold closed under such circumstances. Yo-yos that have been manufactured incorporating the invention described in my '547 patent are commercially available from Yomega Corporation typically have used relatively soft inserts such as those formed from brass. Another inefficient result of making such yo-yos with conventional insert molding techniques is that in the event that a molded plastic yo-yo half is not properly formed it cannot, as a practical matter, be recycled and remolded because of presence of the embedded brass insert. The rejected yo-yo half must be discarded together with the insert. Even with a moderate rejection rate, when such yo-yos are manufactured in very large quantities, the aggregate cost of the lost plastic and insert can become a significant cost factor.

Also among the difficulties that may be encountered with the prior yo-yos is that where the threaded inserts are relatively soft as compared to the steel from which the axle of the yo-yo is formed, there may be some tendency for the threads between the axle and the insert to become stripped should the yo-yo be overtightened by the user. Should the threads become stripped, the yo-yo is no longer usable.

The yo-yo construction described in my '547 patent, made with insert molding techniques, typically requires that the mold be operated manually by an operator. The inserts are loaded manually onto the core pins. The mold then is closed and locked. The injection step then is performed and monitored. The mold then is opened to remove the molded products, at which time the process is repeated. The procedure necessarily is subject to human error and, also necessarily results in substantial unused mold time when the mold is opened, re-loaded with inserts and closed during the insert loading process.

It would be desirable to provide a yo-yo construction and technique for its manufacture that avoids the above difficulties.

SUMMARY OF THE INVENTION

In the present invention, the yo-yo halves are molded without placing inserts in a mold cavity. The use of insert molding is made unnecessary. Consequently, the yo-yo halves can be made on continuous automated injection molding machinery with substantial higher production capability and operator efficiency than with insert molding. The yo-yo halves are molded to include a socket aligned with the central axis of the yo-yo half. The socket is open at a face of the yo-yo half, defining an insertion end, and is polygonal in cross section. The socket is relatively deep and is adapted to receive, in an interference fit, a similarly shaped threaded insert, by press fitting the insert into the socket. The socket is formed with a shallow registration socket adjacent its insertion end that is slightly larger in cross-section than the socket but having a shape to facilitate orientation and alignment of the nut with the polygonal socket. With the nut being properly aligned with the socket, the nut then can be press fitted into the socket. The polygonal configuration of the socket and nut assure that the nut cannot become loosened within the plastic. Additionally, by attaching the nut to the yo-yo half in a separate procedure, after the yo-yo half has been molded, the nut can be formed from the same material as the yo-yo axle, e.g., steel, so that there is less risk of the connecting threads being stripped.

It is among the objects of the invention to provide an improved yo-yo construction that avoids the limitations of insert molding techniques; to provide a yo-yo construction in which the axle of the yo-yo is threaded into an insert in each of the yo-yo halves where the inserts are formed from the same or like materials, and to provide an improved process for manufacturing such yo-yos.

DESCRIPTION OF THE DRAWINGS

The foregoing and other objects and advantages of the invention will be appreciated more fully, from the following further description thereof, with reference to the accompanying drawings wherein.

DESCRIPTION OF THE PREFERRED EMBODIMENT

Figure 2:
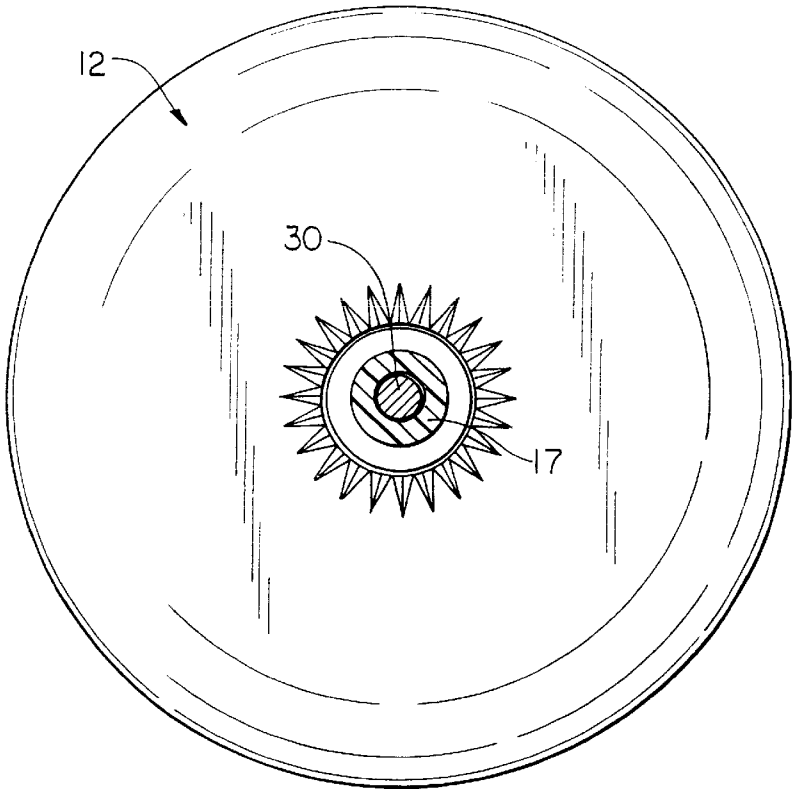
FIG. 2 is an illustration of an internal face of a yo-yo half as seen along the plane 2—2 of FIG. 1.

As shown in the drawings, the yo-yo includes a pair of yo-yo halves 10, 12 which preferably are formed from a suitable plastic made in an injection molded process. Preferably the yo-yo halves are molded from high strength polycarbonate, although other materials may be used. The yo-yo halves may be about 2 ¼ inch in diameter. When the invention is used with the high performance yo-yo described in my '547 patent, the inwardly facing surface 14 of each yo-yo half is formed with a cylindrical socket 16 that, in turn, communicates with a smaller diameter inner bore 18. The socket 16 and bore 18 are aligned with the axis of rotation of the yo-yo. The socket 16 is adapted to receive part of a spool 17 that is rotatably mounted about the axle 30 of the yo-yo. The yo-yo halves are essentially identical. The inner bore 18 communicates with a socket 20 that, in the illustrative embodiment, is open toward the outwardly facing surface 15 of the yo-yo half. In accordance with the invention, the cross sectional configuration of the socket 20 preferably is polygonal, desirably hexagonal. It should be understood, however, that other polygonal shapes may be used. The socket 20 is adapted to receive an internally threaded nut 22 having a polygonal shape adapted to fit, in an interference fit, within the socket 20. Preferably the nut 22 has the same polygonal cross sectional shape as the socket 20. The relative cross sectional dimensions between the nut 22 and the socket 20 should be such as to permit a press fit of the nut in the socket without unduly stressing the plastic of the yo-yo half while also effecting the secure connection. An interference fit of a few thousands of an inch has been found to be satisfactory.

Figure 6:
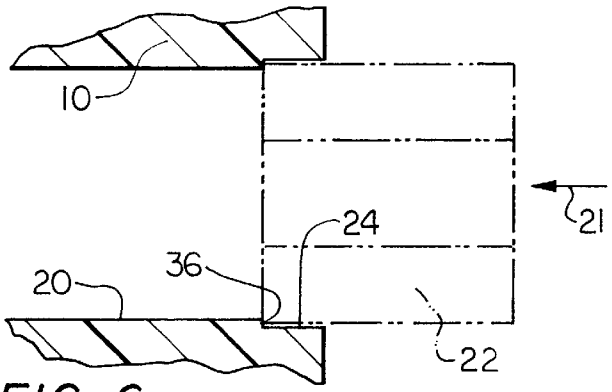
FIG. 6 is a further enlarged diagrammatic illustration of the manner in which the nut insert is aligned with the yo-yo half in readiness for the nut to be press-fitted into its receptive socket.
Figure 3:
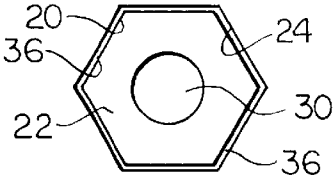
FIG. 3 is an end view of the socket of the yo-yo half as seen from the exterior of the yo-yo along the line 3—3 of FIG.1.

In order to facilitate assembly of the polygonal nut 22 with the yo-yo half, the outer end of the socket 20 is provided with an alignment socket 24 into which an end of the nut 22 can be inserted and which is contoured to engage the inserted end of the nut to align the polygonal shape of the nut 22 with that of the socket 20. The alignment socket may be the identical polygonal shape as the nut 22 and the socket 20. It need be only very slightly wider than the socket 20 and should be sufficiently wide to enable an end of the nut 22 to be inserted without interference. During the press fifting operation, suggested by the arrow 21 in FIG. 6, the assembler need only bring the nut 22 against the alignment socket 24 while rotating the nut 22 until the end of the nut drops into the alignment socket 24. So aligned, the nut then can be pressed fitted into the socket 20. Because the nut is pressed into the yo-yo half in a separate operation, it is not necessary to use the relatively inefficient, labor intensive insert molding techniques described above. Consequently, it is not necessary to form the nut 22 from a softer material than that of the axle 30. Both the nut 22 and the axle 30 can be formed from the same material, such as steel, thereby reducing the risk of threads becoming stripped by firm tightening of the yo-yo halves.

Figure 1:
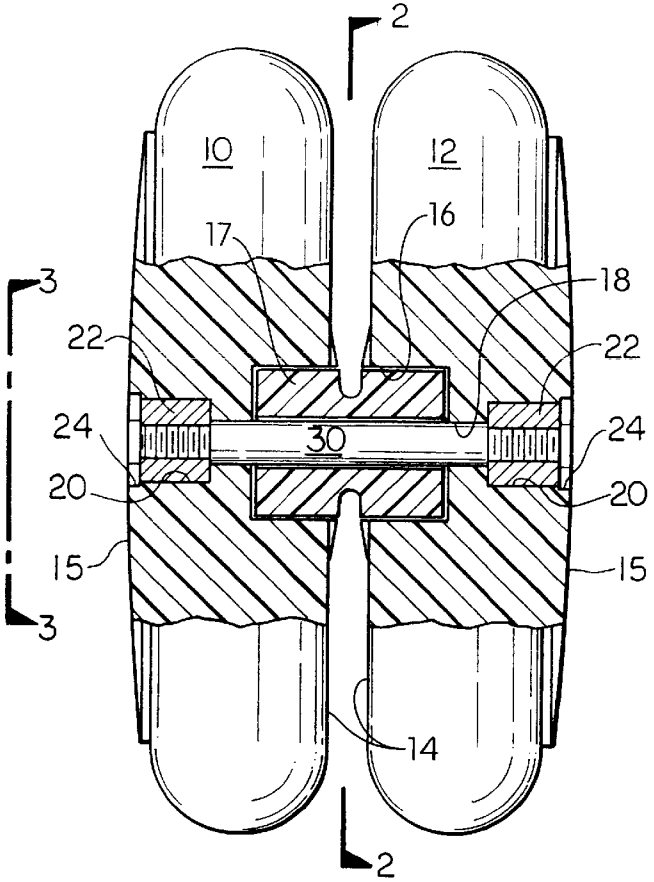
FIG. 1 is a sectional, fragmented illustration of the yo-yo taken in part through the diameter of the yo-yo.
Figure 5:
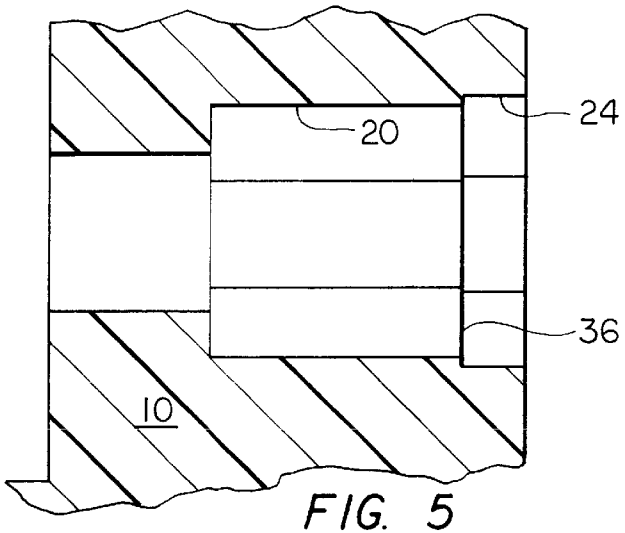
FIG. 5 is a sectional illustration of the region of a yo-yo half in which the nut and axle are received.
Figure 4:
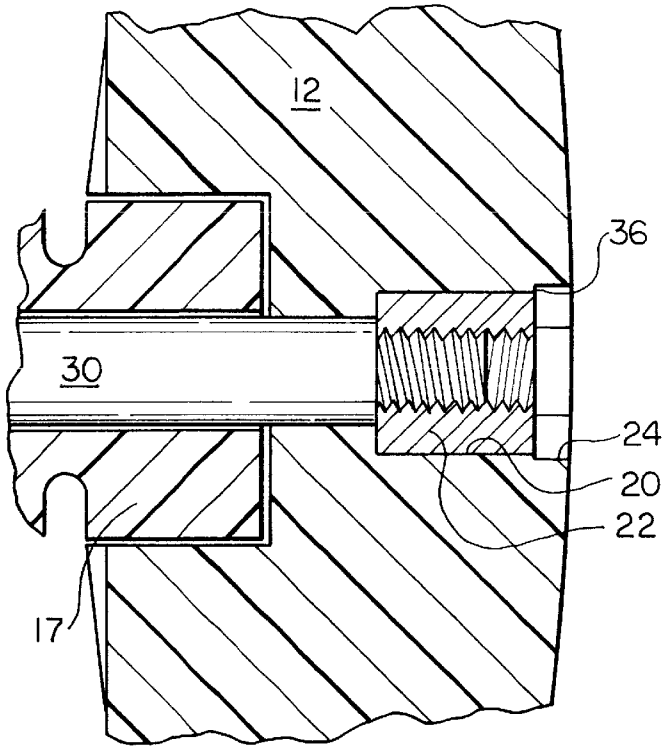
FIG. 4 is an enlarged section taken through the region of the spool and the yo-yo half, showing the structure for attaching the yo-yo axle to the yo-yo half.
Figure 7:
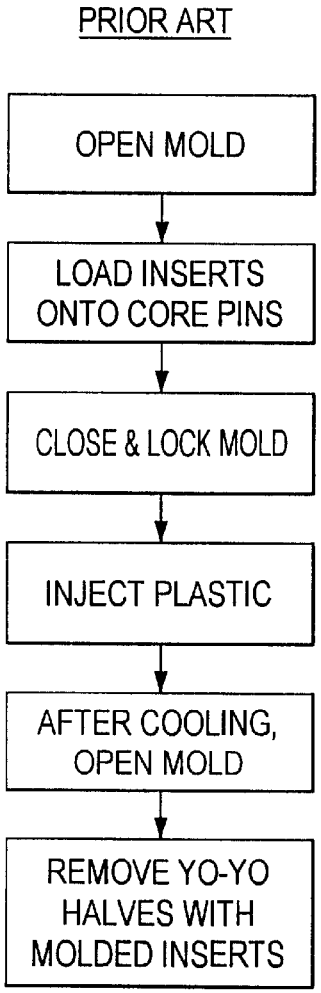
FIG. 7 is a flow chart of a prior art process for forming a yo-yo half.
Figure 8:
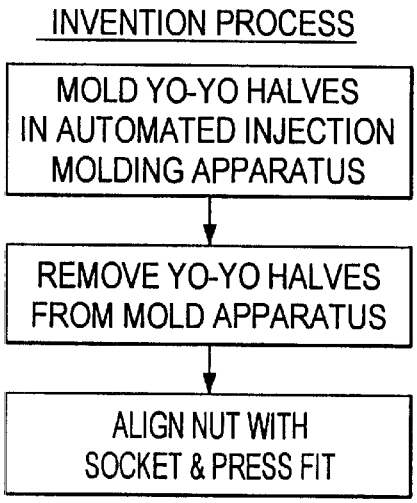
FIG. 8 is a flow chart of the process for forming a yo-yo half in accordance with the invention.

The axle 30 has threaded ends 32, 34 adapted to be screwed into the nuts 22 as shown in FIGS. 1 and 4. The junctures of the unthreaded portion of the axial 30 with 20 the threaded ends 32, 34, define shoulders that abut the inner ends of the nuts 22.

The cylindrical spool 17 is rotatably mounted on the axle 30, the ends of the spool being received, symmetrically, within the sockets 18 in the yo-yo halves. Details concerning the dimensions and other aspects of the spool 17 are disclosed in further detail U.S. Pat. No. 4,895,597, the disclosure of which is incorporated by reference herein, in its entirety.

The nut 22 preferably is made relatively long, longer than the width of the nut 22, and is intended to mate with a similarly long threaded end 32, 34 of the axle 30. The relatively long length of the nut and its secure press fit into the preformed polygonal socket provides a self-registering arrangement in which coaxial alignment of the axis of the nut and of the molded yo-yo half is assured. Consequently, the resulting yo-yo will be well balanced and will maintain uniform spacing between the yo-yo halves, fully about the circumference of the yo-yo. For example, the nut 22 may be about ¼ inch long. In illustrative example, in which the socket 20 is hexagonal, a hexagonal nut can be press fitted into a socket 20 about 0.001 inch smaller in cross section than the socket 20. The depth of the socket 20 may be of the order of ¼ inch with the alignment socket 24 being of the order of 0.020 inches in depth. The cross sectional dimension of the alignment socket may be of the order of 0.190 inches, just slightly larger than that of the nut 22 to permit the nut 22 to be inserted and rested on the shoulder 36 defined between the junctures of the socket 20 and the alignment socket.

Figure 9:
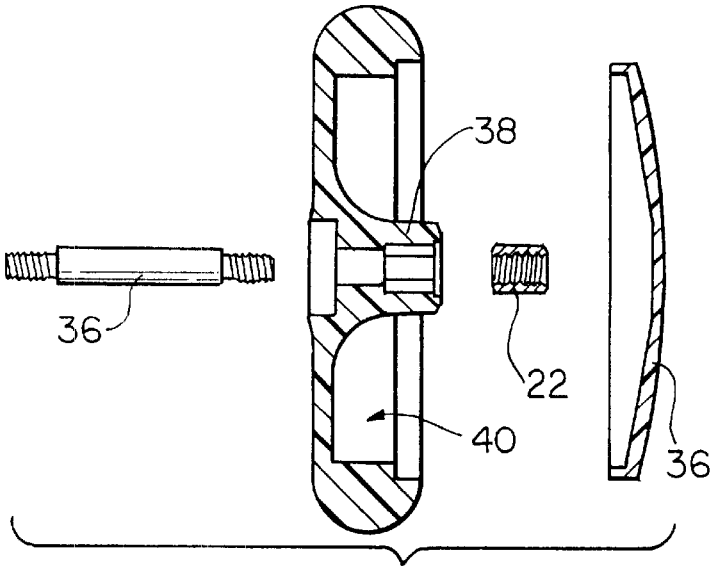
FIG. 9 is an exploded, sectional illustration of a hollow yo-yo half made in accordance with the invention.

Although the invention has been described, for convenience, in connection with solid yo-yo halves, yo-yos often include yo-yo halves that are hollow. FIG. 9 is an illustration of one such yo-yo half and related components, in exploded view, including a cover 36 for the outwardly facing surface of the yo-yo half, the axle 30 and nut 22. The sockets and bore may be formed in a boss 38 that protrudes outwardly into the hollow 40 of the yo-yo half.

From the foregoing, it will be appreciated that the invention provides an improved structure for a yo-yo as well as an improved method for making the yo-yo. The construction avoids the use of insert molding techniques and results in substantial efficiencies. With the invention, yo-yos may be made with improved alignment.

It should be understood that the foregoing description of the invention is intended merely to be illustrative thereof and that other embodiments, modifications and equivalents may be apparent to those skilled in the art without departing from its spirit and scope.

Having thus described the invention, what I desire to claim and secure by Letters Patent is:

1. A yo-yo half comprising:

a molded plastic yo-yo half having an inner face and an outer face;

the yo-yo half having a polygonal socket having an open end; and a polygonal threaded insert received in the socket in an interference fit therewith, the threads of the insert being accessible from the inner face of the yo-yo half for connection to an axle.

2. A yo-yo half as defined in claim 1 wherein the polygonal insert is internally threaded.

3. A yo-yo half as defined in claim 1 wherein the polygonal socket is hexagonal and the insert comprises a hex nut.

4. A yo-yo half as defined in claim 1, further comprising the insert and socket having the same polygonal cross-sectional geometric shape.

5. A yo-yo half as defined in claim 4 wherein the polygonal geometrical shape is a hexagon.

6. A yo-yo half as defined in claim 1 further comprising:

an alignment socket formed at the insert end of the polygonal socket, the alignment socket having a cross-section adapted to receive the end of the polygonal insert so that its cross-sectional configuration is in registry with that of the socket.

7. A yo-yo half as defined in claim 6 wherein the alignment socket is substantially more shallow than that of the polygonal socket.

8. A yo-yo half as defined in claim 6 wherein said polygonal socket, alignment socket and insert all have the same polygonal cross-sectional geometry.

9. A yo-yo half as defined in claim 8 wherein the cross-section of the insert has dimensions that are between those of the polygonal socket and the alignment socket.

10. A yo-yo half as defined in claim 1 further comprising a bore on the inner surface of the yo-yo half adapted to receive an axle, the bore being in communication with the polygonal socket.

11. A yo-yo half as defined in claim 10 further comprising a larger diameter bore at the inwardly facing surface of the yo-yo half, the larger bore being receptive to a spool and communicating with the inner end of the first mentioned bore.

12. A method for making a yo-yo half comprising:

injection molding a yo-yo half in which the yo-yo half includes an outwardly opening socket of polygonal cross-section;

press fitting a threaded insert having cross-sectional dimensions greater than those of the polygonal socket into the socket to secure the two in an interference fit.

13. A method as defined in claim 12 further comprising preliminarily registering the insert at the insertion end of the socket with the socket.

14. A method as defined in claim 13 wherein said step of preliminarily registering the insert with the polygonal socket comprises forming the insertion end of the polygonal socket with a slightly enlarged registration socket adapted to receive an end of the threaded insert in a non-interference fit but in geometrical alignment with the polygonal socket.

15. A yo-yo half comprising:

a molded plastic yo-yo half having an inner face and an outer face;

the yo-yo half having a polygonal socket with an open end, the socket being adapted to receive a threaded polygonal insert in an interference fit;

the yo-yo half having surfaces defined at the entry to the socket that are contoured to engage the insert to facilitate registration of the polygonal insert with the polygonal socket.

16. A yo-yo half as defined in claim 15 wherein the contoured surfaces are of substantially the same geometrical shape as a portion of the insert.

17. A yo-yo half as defined in claim 15 wherein the contoured surfaces define a shoulder and a wall about the shoulder having substantially the same geometric shape as that of the periphery of at least a portion of the insert.

18. A yo-yo half comprising:

a molded plastic yo-yo half having an inner face and an outer face;

the yo-yo half having a polygonal socket with an open end at its outer face, the socket being adapted to receive a threaded insert in an interference fit; and means defining the open end of the socket for engagement with the insert to align the insert in registry with the socket.

19. A yo-yo half construction comprising:

a molded plastic yo-yo half having an inner face and an outer face;

the yo-yo half having a polygonal socket having an open end at the outer face;

the open end of the socket having a shoulder to define a polygon of slightly greater dimensions than those of the more inwardly disposed portions of the socket.

20. A yo-yo half comprising:

a molded plastic yo-yo half having an inner face and an outer face;

the yo-yo half having a polygonal socket with an open end at the outer face of the yo-yo half, the socket being receptive to a polygonal threaded insert in an interference fit; and means to facilitate alignment of the polygonal insert with the polygonal socket whereby the insert may be oriented in registry with the socket to be in readiness to be pressed into the socket in an interference fit therewith.

21. A yo-yo comprising:

a pair of yo-yo halves as defined in any one of claims 1–11 and 16–20;

the yo-yo halves being connected to each other by an axle having threaded ends engaged securely with the nuts in the yo-yo halves.

22. A yo-yo half comprising:

a molded plastic yo-yo half having opposite faces;

the yo-yo half having a socket with an end open at one face of the yo-yo half shaped to a predetermined geometry;

a threaded insert having a geometry corresponding to that of the socket with the insert being received in the socket in an interference fit, the threads of the insert being accessible from the opposite face of the yo-yo half for connection to an axle.

23. A yo-yo half as defined in claim 22 further comprising the open end of the socket being contoured to engage an end of the insert to facilitate alignment and registration of the geometries of the socket and the insert before the insert is inserted into the socket.

24. A method for making a yo-yo half comprising:

injection molding a yo-yo half from a polymeric material in which the yo-yo half includes a central socket having a predetermined geometrical configuration; and press fitting a threaded insert into the socket, the geometry and dimensions of the insert being selected to require press fitting of the insert into the socket so that the insert and yo-yo half are securely attached to each other.

* * * * *